United States Patent [19]

Strutton

[11] 4,225,127

[45] Sep. 30, 1980

[54] NATURAL CHILDBIRTH POSITIONER

[76] Inventor: Bernice M. Strutton, 3344 St. James Pl., Antioch, Calif. 94509

[21] Appl. No.: 957,098

[22] Filed: Nov. 3, 1978

[51] Int. Cl.[3] ..... A61G 13/00

[52] U.S. Cl. ..... 269/325; 269/328

[58] Field of Search ..... 269/322–328; 297/68, 88, 346

[56] References Cited

U.S. PATENT DOCUMENTS

| | | | |
|---|---|---|---|
| 2,073,094 | 3/1937 | Bugh | 269/327 |
| 2,177,341 | 10/1939 | Demcak | 269/325 |
| 3,227,439 | 1/1966 | Carlson | 269/325 |
| 3,318,596 | 5/1967 | Herzog | 269/324 |
| 4,057,240 | 11/1977 | Damico et al. | 269/325 |
| 4,139,917 | 2/1979 | Fenwick | 269/325 |

*Primary Examiner*—Robert C. Watson
*Attorney, Agent, or Firm*—Phillips, Moore, Weissenberger, Lempio & Majestic

[57] ABSTRACT

A natural childbirth positioner is presented for allowing an expectant woman to give birth to her child while in a natural squatting position. For many hundreds of years women have been giving birth while in the supine position. With the woman so positioned, uterine pressure can interfere with the flow of blood from the uterus to the infant, causing the supply of oxygen to the infant to be dangerously reduced. Contrastingly, childbirth in the squatting position, as provided for by the present invention, allows the woman's abdomen and diaphragm muscles to give an effective and strong push with each labor contraction and thus can shorten delivery time. In practice the natural childbirth positioner allows the expectant woman to assume a supine position preparatory to and immediately after child delivery. However, with the onset of closely spaced contractions, the expectant woman can be moved to and held comfortably in the squatting position.

4 Claims, 6 Drawing Figures

NATURAL CHILDBIRTH POSITIONER

TECHNICAL FIELD

The invention relates to a natural childbirth positioner for comfortably positioning an expectant woman in a squatting position during childbirth.

BACKGROUND ART

For the past several hundred years women in Western society have been giving birth to children while in the supine position. Generally the expectant women are heavily sedated or anestheticized so that she can endure the sometimes painful process of childbirth in the supine position. Further with the woman in the supine position, uterine pressure can interfere with blood flow from the uterus to the child during childbirth. Such interference can reduce the supply of oxygen to the infant to a dangerously low level. Mental retardation of the infant can be a result of such oxygen reduction.

One of the reasons for having the woman give birth in a squatting position is the convenience of the attending physician. With the woman reclining on a surgical table, the attending physician can most easily access the child as birth proceeds.

However, it is important to note that many births outside of the Western World take place with the woman in the squatting position. And it is to be pointed out that lower animals give birth naturally in the squatting position.

Thus there is a need to provide an apparatus which will allow an expectant woman to give birth in a squatting position while allowing the attending physician proper access to the child as delivery progresses.

DISCLOSURE OF THE INVENTION

The present invention is directed to overcoming one or more of the problems as set forth above.

In one aspect of the present invention a positioner includes a table, a chair back pivotably mounted to the table, and means for pivoting the chair back relative to the table. The table defines a chair seat. The chair seat at least partially defines an aperture therethrough. The positioner also includes first and second leg supports and means for pivotably securing the legs supports to the table.

An aspect of the invention includes means for removably securing the leg supports to the table.

A further aspect of the invention includes a drop leaf pivotably secured to the table and selectively positionable in the same plane as the table to allow the woman to lie in a supine position on the table preparatory to and immediately after child delivery.

Still a further aspect of the invention includes a telescoping base upon which the table is mounted. The base allows the table to be positioned so that the attending physician can easily access the child during delivery.

Still another aspect of the invention includes adjusting mechanisms for adjusting the legs supports to conform to the shape of the expectant woman.

With the onset of the closely spaced contraction, the woman is pivoted from the supine position to the squatting position so that childbirth can proceed in an easier and safer manner. With the woman in the squatting position, her abdomen and diaphragm muscles can give an effective and strong push with each labor contraction and thus can shorten the delivery time. Further as the delivery time is shortened and as there are fewer stresses on the woman as she is delivering, the need for sedatives or anesthetics can be greatly reduced or become unnecessary. Thus the woman can be fully aware of the childbirth process and the child can be born without the effect of such sedation. Further there should be no reduction of oxygen to the infant due to uterine pressure which can interfere with the flow of blood from the uterus to the child. As has been previously indicated, such reduction in the supply of oxygen can cause irreversible mental retardation in the child.

BEST MODE FOR CARRYING OUT THE INVENTION

Figure 1:
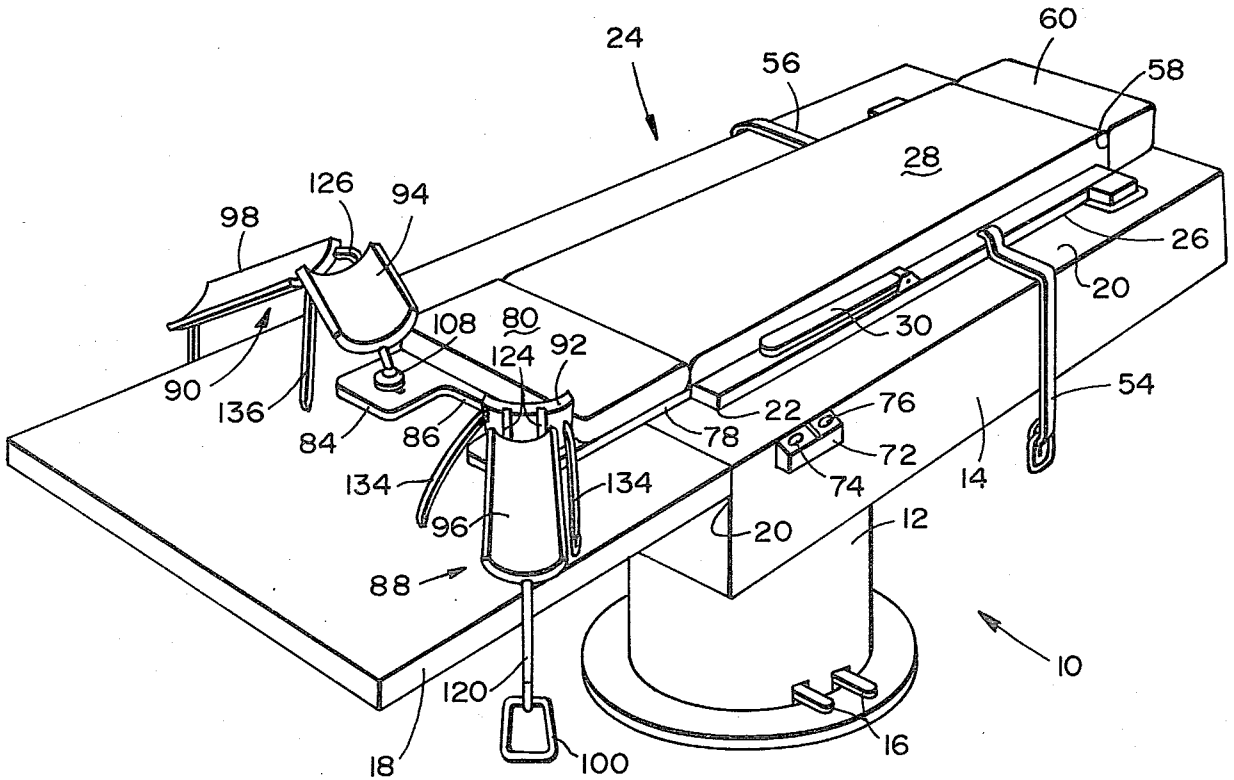
FIG. 1 is a perspective view of the natural childbirth positioner with a chair back thereof and a drop leaf portion of a table in the same horizontal plane.

Referring to the figures, and particularly to FIG. 1, a natural childbirth positioner is depicted and generally denoted 10. The positioner includes a base 12 upon which is mounted a surgical table 14. Base 12 is telescopic, responsive to the positioning of pedals 16. The table 14 can be raised or lowered so as to most advantageously position a woman positioned in the positioner 10 relative to an attending physician. Base 12 is of the type which is well known in the art and can include, for example, the telescopic bases which are used with dental chairs.

Figure 2:
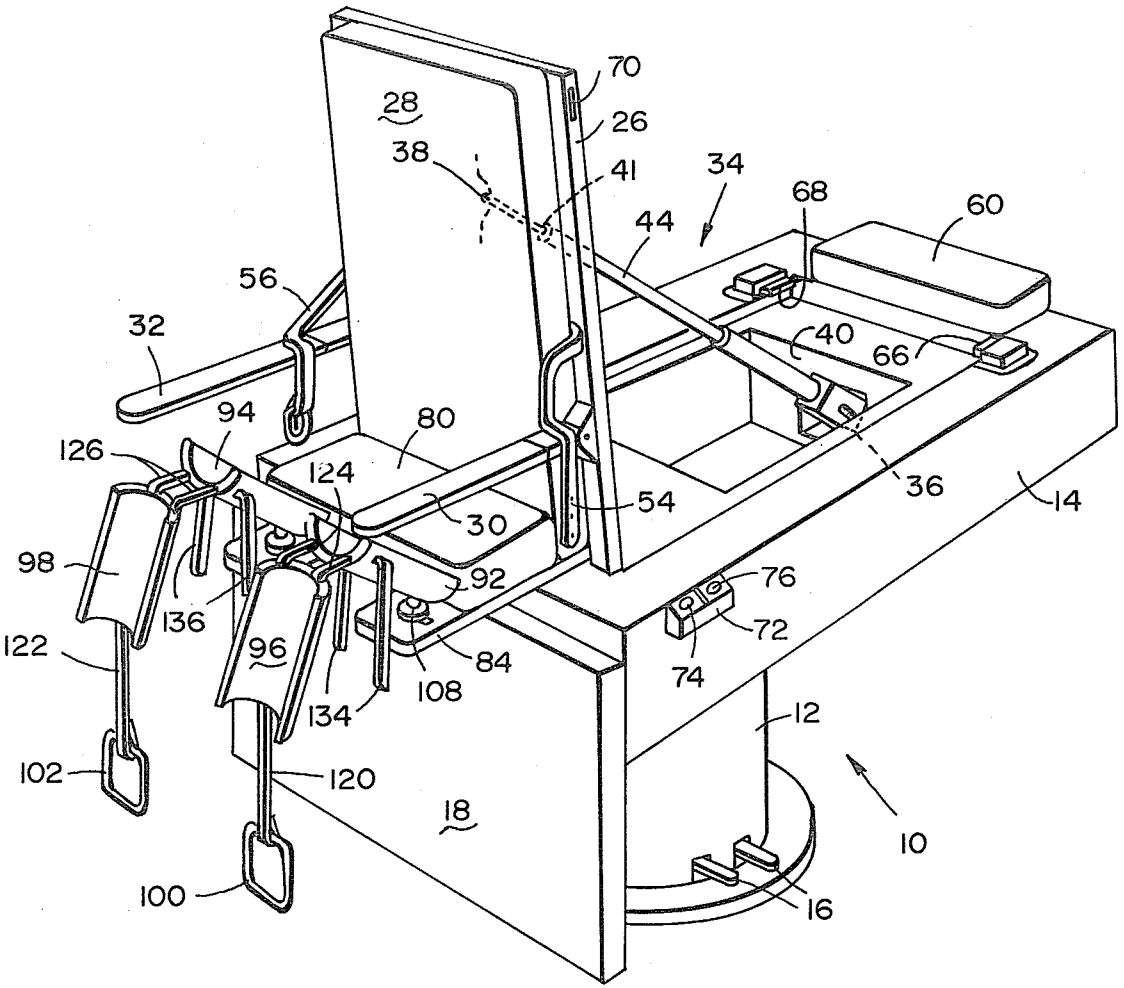
FIG. 2 depicts a perspective view of the embodiment of the invention of FIG. 1 with the chair back pivoted to a position somewhat forward of the vertical position and the drop leaf pivoted to a position substantially normal with the rest of the table.

Pivotably mounted to surgical table 14 is a drop leaf extension 18. Drop leaf extension 18 is pivotable about pivot point 20 from a horizontal plane substantially coincident with the horizontal plane of the upper surface 20 of surgical table 14 to a vertical position as depicted in FIG. 2 which is substantially perpendicular to the upper surface 20 of surgical table 14.

Pivotably mounted to the upper surface 20 of table 14 at pivot point 22 is a chair back 24. As can be seen in FIGS. 1 and 2 chair back 24 includes a rigid back member 26. The cushion 28 is secured to the rigid back member 26. Alternatively a number of unsecured pillows (not shown) can replace cushions 28. First and second arm rests 30 and 32 respectively, are pivotably mounted to the rigid back member 26 and selectively positionable so as to be either adjacent and generally parallel to the rigid back member 26 as depicted in FIG. 1 or generally perpendicular to the rigid back member as depicted in FIG. 2.

The hydraulic cylinder 34 (FIG. 2) is operably associated with the surgical table 14 and the rigid back member 26. The head end of hydraulic cylinder 34 is pivotably mounted to the table at pivot point 36 while the rod end of the hydraulic cylinder is pivotably mounted to the rigid back member at pivot point 38. Further as can be seen in FIG. 2, the hydraulic cylinder is housed in a well 40 defined by the surgical table 14.

Figure 3:
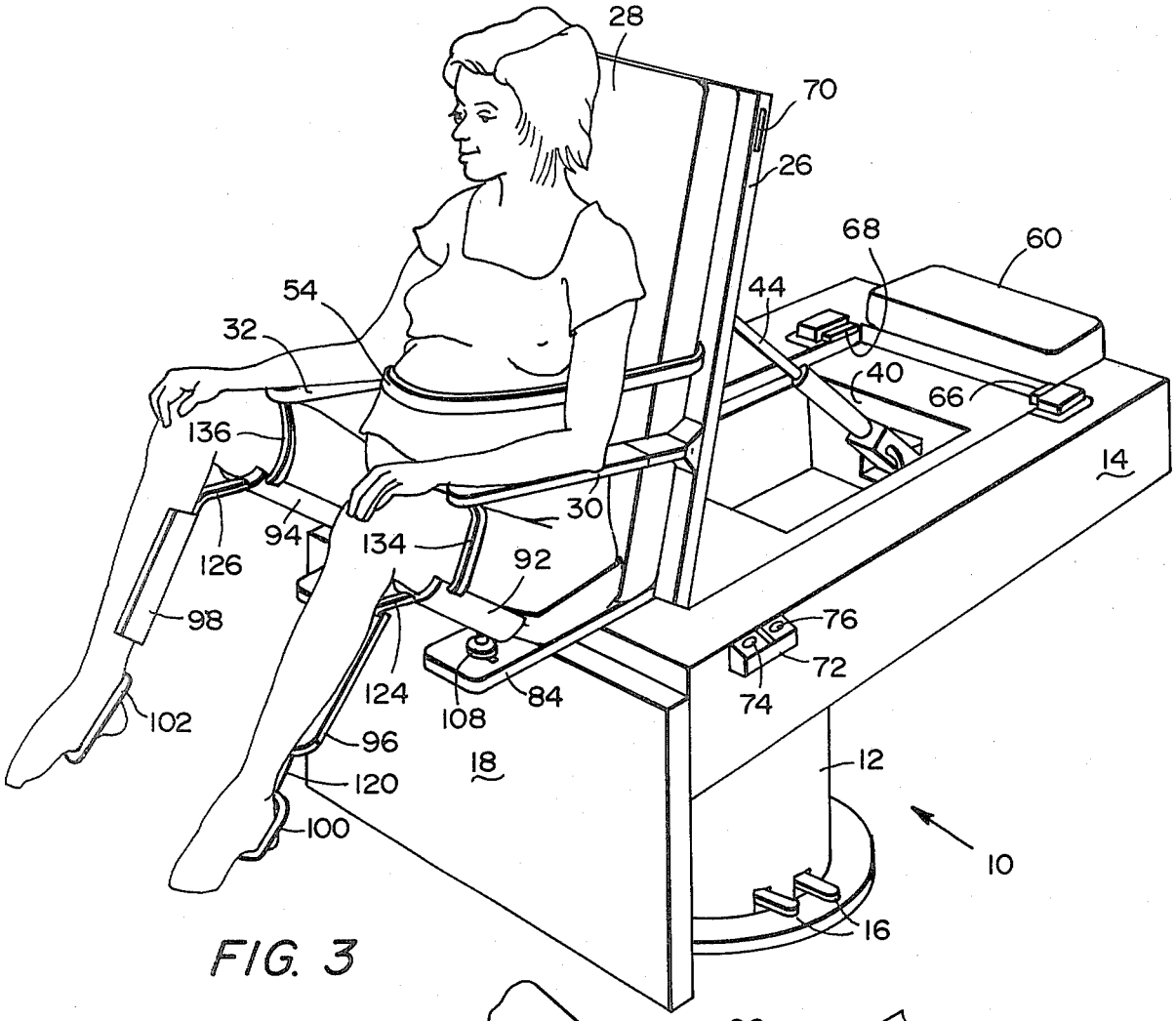
FIG. 3 depicts an expectant woman positioned in the natural childbirth positioner with the chair back reclined several degrees from the vertical.
Figure 4:
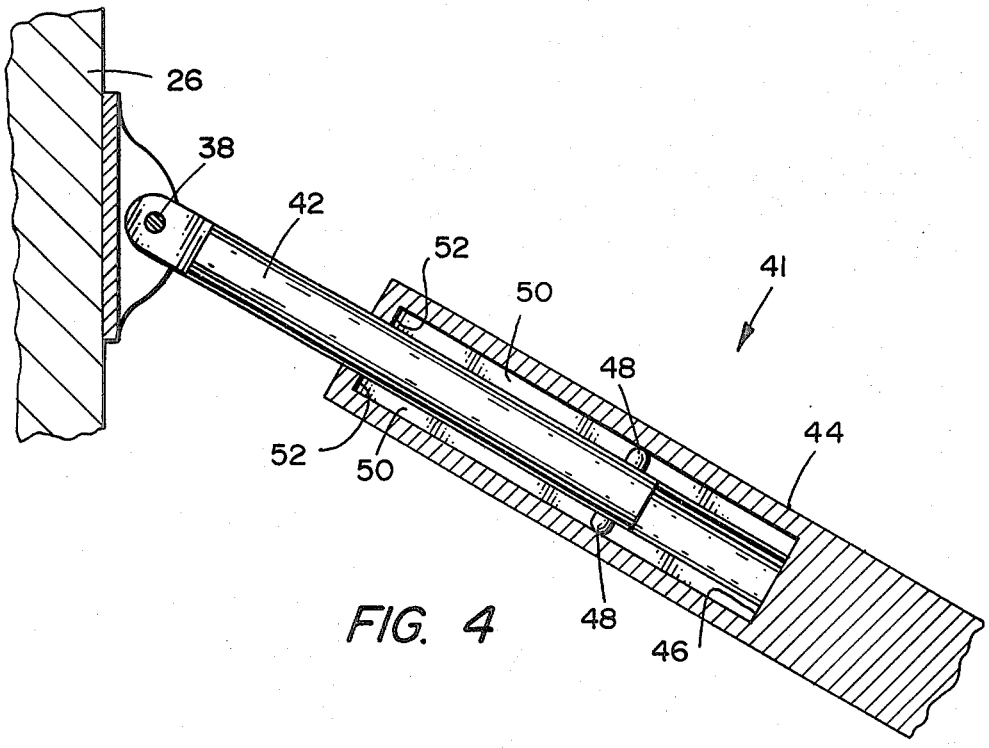
FIG. 4 depicts an enlarged cross-sectional view of a telescoping portion of the rod of a hydraulic cylinder.

Referring to FIG. 4, a cross-sectional view of a portion of rod 41 of hydraulic cylinder 34 reveal that rod 41 includes a general cylindrical rod position 42 slidingly and telescopingly received in a cylindrical sleeve 44. As previously indicated cylindrical rod 42 is pivotably secured to the rigid back member 26 at pivot point 38. Cylindrical sleeve 44 includes a stop 46 for limiting the extent to which cylindrical rod 42 can be slidingly received in cylindrical sleeve 44. Further cylindrical rod 42 includes two tabs 48 which limit the extent to which cylindrical rod 42 can telescope out of cylindrical sleeve 44. Tabs 48 are received in grooves 50 defined by the inner surface of cylindrical sleeve 44. The ends 52 of the grooves 50 which are located adjacent to the end of the cylindrical sleeve 44 contact the tabs 48 to define the telescopingly most extended position of cylindrical rod 42 with respect to cylindrical sleeve 44. In a preferred embodiment, for reasons which will be discussed more fully hereinbelow, with the chair back 24 pivoted to a reclining position of substantially 10° from the vertical, as depicted in FIG. 3, rod 42 can be telescoped manually out of sleeve 44 to such an extent that the chair back 24 is manually pivotable to a forwardly leaning position of approximately 10° (FIG. 2).

Attached to the rigid back member 26 are two straps 54 and 56 which can be used as described hereinbelow to restrain and support a woman in positioner 10.

Located near the head end 58 of the chair back 24, with the chair back positioned parallel to and against the table, is a head rest 60. Further secured to the table 14 are first and second locking mechanisms 62 and 64. Locking mechanisms 62 and 64 are positioned adjacent head rest 60 and are located on either side of the head end 58 of the pivotable chair back 24 with said back in the fully reclined position in contact with surgical table 14. Locking mechanisms 62 and 64 include extendable pins 66 and 68 respectively which are shown in an extended position in FIG. 2. These pins are extendable into slots such as slot 70 defined by the head end of the chair back. The pins are retracted until the chair back is adjacent and parallel to the table. With the chair back so positioned the pins are extended into the slots to lock the chair back to the table.

A control console 72 is affixed to the surgical table 14. Control console 72 includes a first button 74 for controlling the position of the hydraulic cylinder 34 and a second button 76 for controlling the extension and retraction of the pins 66 and 68.

Secured to the surgical table 14 adjacent the pivot point 22 is a chair seat 78 which has a cushion 80 affixed thereto. Chair seat 78 includes first and second spaced apart arms 82 and 84 which define a U-shaped indentation 86 therebetween.

Removably and pivotably mounted to arms 82 and 84 are leg supports 88 and 90 respectively. As can be seen in FIGS. 1 through 3, leg supports 88 and 90 include generally elongate and U-shaped thigh supports 92 and 94 respectively, generally elongate and U-shaped calf supports 96 and 98, respectively, and heel stirrups 100 and 102 respectively.

Figure 5:
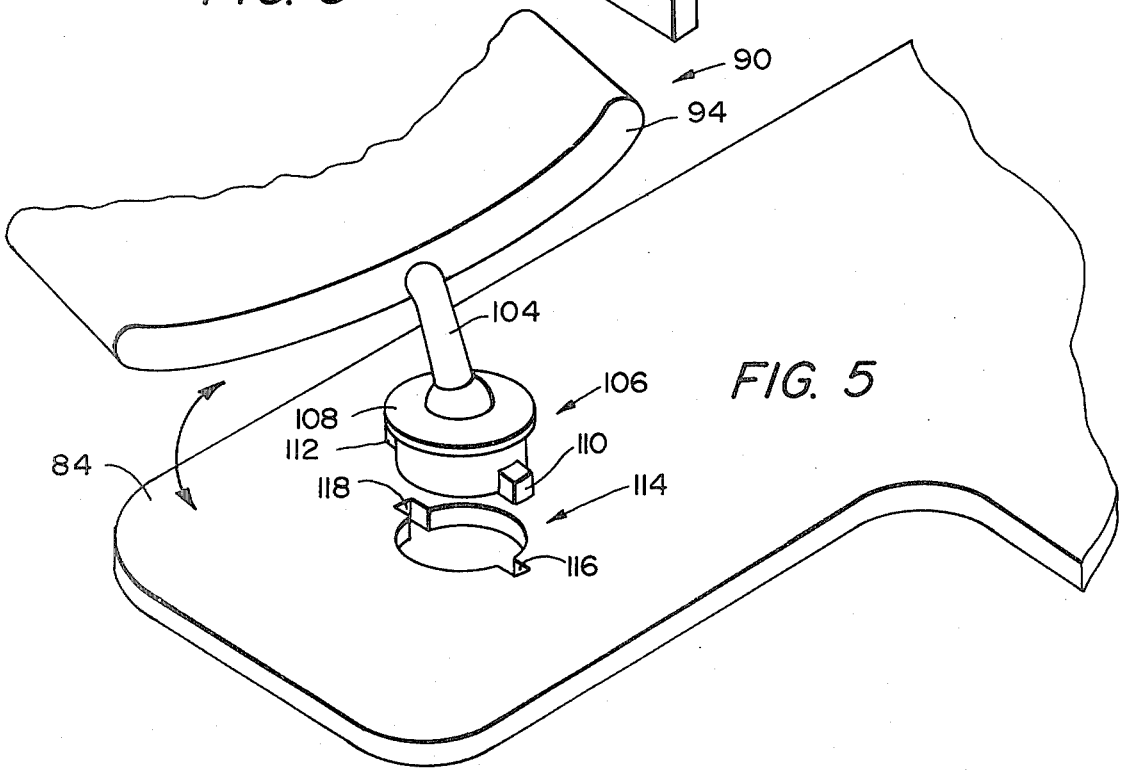
FIG. 5 depicts an enlarged perspective view, partially broken away of one of the legs supports positioned above and removed from a portion of the seat of the natural childbirth positioner.

With reference to FIG. 5, and noting that the following discussion applies equally well to leg support 88, leg support 90 includes an extension 104 to which is secured a cylindrical body 106. Cylindrical body 106 has a peripheral flange 108 extending from the cylindrical surface thereof. Spaced from the peripheral flange 108 and also extending from the cylindrical surface of cylindrical body 106 are a pair of diametrically opposed, cubically shaped tabs 110 and 112. As can be seen in FIG. 5, an aperture 114 is provided in arm 84 of the chair seat 78. An identical aperture is provided in arm 82 of said chair seat. The aperture 114 is generally cylindrical in shape and has a diameter slightly greater than the diameter of the cylindrical body 106 and less than the diameter of peripheral flange 108. Aperture 114 includes a pair of diametrically opposed grooves 116 and 118 which are positioned and shaped to receive tabs 110 and 112 respectively. Cylindrical body 106 can be inserted into aperture 114 with tabs 110 and 112 inserted through grooves 116 and 118 and with flange 108 contacting the chair seat 78. So positioned, the tabs 110 and 112 extend through the aperture and to the other side of the chair seat. Thus the tabs do not obstruct the pivoting of the cylindrical body 106 in the aperture 114. Further the tabs prevent the accidental removal of the cylindrical body 106 and thus the legs support from the chair seat during the pivoting of the legs support with respect to the chair seat. In other words, as depicted in FIG. 5, grooves 114 and 116 are generally perpendicular to the final position of the leg supports, which position is shown in FIG. 3 as extending away from and along the longitudinal line of the surgical table 114. With the leg supports so positioned, the tabs are generally perpendicular to the grooves.

Figure 6:
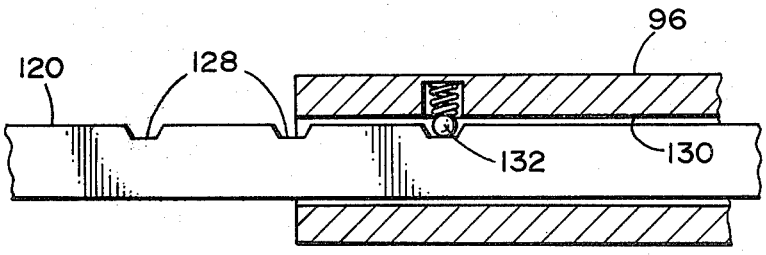
FIG. 6 depicts an enlarged cross-sectional view of a portion of a stirrup of the leg support as it is positionably secured to a calf support of the leg support.

As can be seen in FIG. 2, heel stirrups 100 and 102 are secured to the calf supports 96 and 98 by rods 120 and 122. Further rods 124 connect calf support 96 to thigh support 92 and rods 126 connect calf support 98 to thigh support. It is to be understood that rods 120 and 122 are extendable from and retractable into calf supports 96 and 98, respectively, and that rods 124 and 126 are extendable from and retractable into thigh supports 92 and 94 respectively. The mechanism which allows such retraction and extension of the rods 120, 122, 124 and 126 is depicted in FIG. 6. While the following discussion will refer in specific to rod 120 and calf support 96 it is to be understood that the discussion applies equally well to the mechanisms of the other rods.

With reference to FIG. 6, it is seen that rod 120 includes a plurality of space indentations 128. Calf support 96 defines a bore 130 in which rod 120 is slidingly received. Mounted in bore 130 is a spring loaded detent 132. Detent 132 is urged by the spring thereof into each indentation 128 to selectively position the rod 120 with respect to the calf support 96. In order to reposition the rod, the rod must be physically pulled out of or pushed into the calf support with sufficient force to overcome the detent.

Secured to each thigh support is a pair of straps 134 and 136 respectively. As depicted in FIG. 3, these straps can be placed around the thighs of the woman.

INDUSTRIAL APPLICABILITY

The operation of the natural childbirth positioner is as follows. Initially, the chair back 24 is disposed in a horizontal position locked to the surgical table 14 by locking mechanisms 62 and 64 as depicted in FIG. 1. The drop leaf extension 18 is pivoted to a horizontal position so as to lie in the same plane as surgical table 14. The leg supports 88 and 90 are removed from the chair seat 78. With the positioner so configured, the expectant woman is allowed to rest on the positioner with her back against the chair back and her posterior against the chair seat. With the expectant woman so positioned, the leg supports are secured to the chair seat in the manner described hereinabove. Once the contractions of the expectant woman begin to occur at regular intervals, the leg supports are pivoted generally in line with the longitudinal axis of the surgical table as depicted in FIG. 3. The woman's legs are moved into the leg supports and strapped in if such restraints are desired, and the drop leaf extension is pivoted downwardly to a position generally perpendicular to the surgical table as depicted in FIG. 3. The woman is then strapped to the chair back. The chair back is pivoted to a reclining position generally 10° from the vertical as depicted in FIG. 3. If so desired, the arm rests are selectively positioned so that they are generally perpendicular to the chair back. During contraction the woman will naturally thrust herself forward. As has been indicated above, during such contractions the cylindrical rod 42 of the hydraulic cylinder will extend from the cylindrical sleeve 44 thereof automatically and responsive to the thrusting of the woman forwardly. After contraction has finished, the woman will lean back against the chair back and the cylindrical rod will be urged into the cylindrical sleeve preparatory to the next contraction. The child will be born and received into the attending physician's hands through the U-shaped indentation 86 of the chair seat. Again it is to be noted that to accommodate the physician the height of the positioner can be adjusted by operating pedal 16 of base 12 in a manner described hereinabove.

Other aspects, objects, and advantages of this invention can be obtained from a study of the drawings, disclosure, and the appended claims.

What is claimed is:

1. A positioner including:

a base;

a chair back pivotably mounted to said base;

means for pivoting said chair back relative to said base;

said base defining a chair seat, said seat defining an aperture therethrough;

first and second leg supports;

means for pivotably securing the leg supports to said base including a substantially cylindrical extension secured to each said leg support and wherein said base defines a substantially cylindrical aperture which receives each said substantially cylindrical extension, and means for removably securing each of said leg support to said base; and wherein the means for removably securing each said leg support to said base includes at least one tab secured to each said substantially cylindrical extension and at least one indentation in the periphery of each cylindrical aperture, and each substantially cylindrical extension including a peripheral lange space from the tab.

2. The apparatus of claim 1 wherein said base is telescopic.

3. The apparatus of claim 1 including means for locking said chair back in a preselected position.

4. A positioner including:

a base;

a chair back pivotably mounted to said base;

means for pivoting said chair back relative to said base;

said base defining a chair seat, said seat defining an aperture therethrough;

first and second leg supports;

wherein each said leg support includes a thigh support, a calf support and a heel stirrup, and wherein each of said leg support includes means for securing the calf support to the thigh support and means for securing the heel stirrup to the calf support;

means for pivotably securing the leg supports to said base;

wherein said means for securing the calf support to the thigh support is adjustable such that the calf support is selectively positionable with respect to the thigh support and wherein said means for securing the heel stirrup to the calf support is adjustable such that the heel stirrup is selectively positionable with respect to the calf support; and wherein the means for securing the calf support to the thigh support includes a detent and the means for securing the heel stirrup to the calf support includes a detent.

* * * * *

UNITED STATES PATENT AND TRADEMARK OFFICE

CERTIFICATE OF CORRECTION

PATENT NO. : 4,225,127

DATED : September 30, 1980

INVENTOR(S) : Bernice M. Strutton

It is certified that error appears in the above—identified patent and that said Letters Patent is hereby corrected as shown below:

Column 6, line 14, "lange" should be --flange--.

Signed and Sealed this

*Twentieth* Day of *January 1981*

[SEAL]

*Attest:*

RENE D. TEGTMEYER

*Attesting Officer*

*Acting Commissioner of Patents and Trademarks*